United States Patent [19]

Mason

[11] 4,301,388

[45] Nov. 17, 1981

[54] COLOR CODING OF WRITE-THROUGH INFORMATION IN DIRECT VIEWING BISTABLE STORAGE CRT DISPLAY

[75] Inventor: William M. Mason, Sherwood, Oreg.

[73] Assignee: Tektronix, Inc., Beaverton, Oreg.

[21] Appl. No.: 802,615

[22] Filed: Jun. 2, 1977

[51] Int. Cl.[3] ..... H01J 31/58; H01J 29/10

[52] U.S. Cl. ..... 313/398; 313/461

[58] Field of Search ..... 313/473, 398, 391, 468, 313/461 (U.S only), 397

[56] References Cited

U.S. PATENT DOCUMENTS

| | | | |
|---|---|---|---|
| 3,522,463 | 8/1970 | Bishop | 313/473 |
| 3,742,291 | 6/1973 | Yamada | 313/468 X |
| 3,780,371 | 12/1973 | Rymes | 313/473 X |
| 3,978,366 | 8/1976 | Steele | 313/398 |
| 4,110,659 | 8/1978 | Mason et al. | 313/398 |

OTHER PUBLICATIONS

Zworykin and Morton, "Television," John Wiley & Sons, Inc.; London; 1940; p. 238 cited.

*Primary Examiner*—Robert Segal
*Attorney, Agent, or Firm*—John D. Winkelman

[57] ABSTRACT

A color difference between stored and write-through (unstored) information displayed by a direct viewing bistable storage CRT is achieved by admixing the storage phosphor with a second phosphor that emits light of a distinctly different color. The second phosphor is chosen to have a lower relative light output efficiency than the storage phosphor under low voltage, flood gun illumination conditions.

10 Claims, 2 Drawing Figures

COLOR CODING OF WRITE-THROUGH INFORMATION IN DIRECT VIEWING BISTABLE STORAGE CRT DISPLAY

BACKGROUND AND OBJECTS OF THE INVENTION

The present invention relates to cathode ray storage tubes, and more particularly to a direct viewing bistable storage tube that displays write-through information in a color different from that of stored information.

In certain applications of direct viewing bistable storage CRTs, it is desireable to display, but not store a charge image at the same time another, stored image is being displayed. Such a mode of operation, commonly called "write-through," is used to provide a moving cursor in storage-type computer display terminals, for example. It is also used in interactive graphics terminals to permit selected portions of a display to be moved, changed, or deleted while the rest of the display remains fixed, combining the advantages of refresh and storage graphics.

When operating in write-through mode, stored and unstored charge images are both displayed by a tube's phosphor storage target in the same color (typically green). This may make it difficult to distinguish one from the other, particularly when the stored and write-through images partially overlap. In addition, because write-through images are often of lower brightness than stored images, they may be hard to see if the storage tube has a high background luminance of the same color.

A principal object of the present invention, therefore, is to provide a direct viewing bistable storage tube in which write-through charge images are displayed in a different color than stored charge images.

A related object of the invention is to provide a bistable storage tube in which write-through information is displayed in a color that differs from the background color of the tube's display screen.

Another object of the invention is to provide a bistable storage display screen that produces light images of one color when illuminated by a high energy writing beam, and stored light images of a different color when illuminated only by a low energy flood gun.

Still another object of the invention is to provide a method for displaying stored and write-through charge images on an admixed phosphor bistable storage target in different colors.

SUMMARY OF THE INVENTION

These and other objects are realized according to the present invention by providing a direct viewing storage CRT target having a storage dielectric of admixed phosphor material. The admixed material includes at least two phosphors having different color emission characteristics: one a storage phosphor and another a phosphor that emits light of a color different, preferably distinctly different, from that of the storage phosphor, and that has a lower relative light output efficiency than the storage phosphor under low energy flood gun illumination.

When a charge image stored on the phosphor dielectric is bombarded only by low velocity electrons from the storage tube flood guns, the visible light image that results is produced primarily by the storage phosphor, as is any background luminance. However, areas of the target bombarded by high velocity electrons from the writing gun during operation in write-through mode emit light that is a mixture of the two phosphors' characteristic colors. Write-through information thus is displayed in a color different from that of stored information, and different from that of the background luminance, greatly increasing the visual contrast between them.

Further objects, features and advantages of the present invention will become evident as the following detailed description is read in conjunction with the accompanying drawing.

DETAILED DESCRIPTION OF PREFERRED EMBODIMENT

Figure 1:
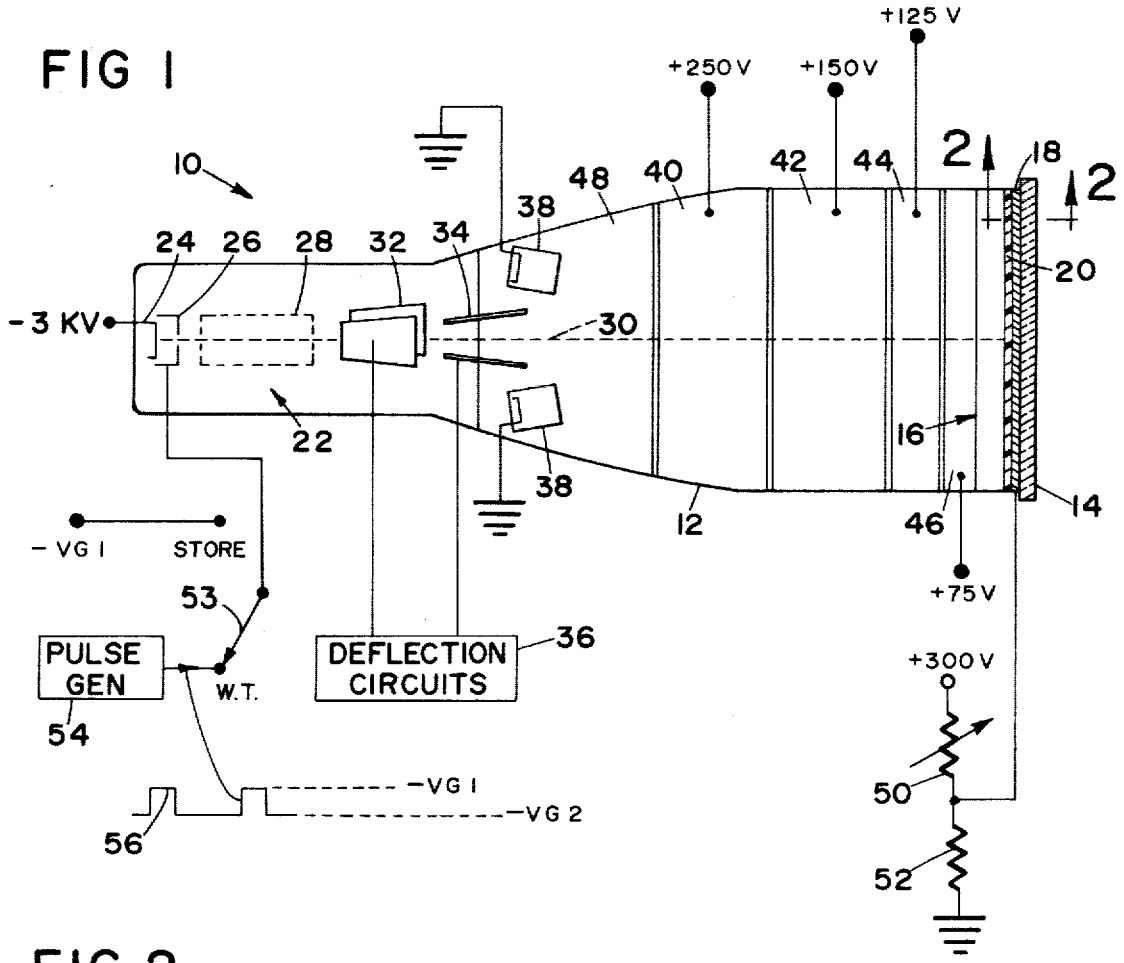
FIG. 1 is a diagrammatic view of a direct viewing storage cathode ray tube in accordance with the present invention, together with associated circuitry.

Referring first to FIG. 1, a direct viewing bistable storage tube 10 includes an evacuated envelope 12 having a transparent faceplate 14 at one end. Supported by faceplate 14 is a storage target 16 that includes a conductive target electrode 18 and a storage dielectric layer 20. Mounted in the opposite end of the tube is a writing gun 22 comprising a cathode 24, a control grid 26, and a focusing and accelerating anode structure 28 for forming a beam 30 of high velocity electrons directed toward target 16. Beam 30 is deflected by signals applied to horizontal deflection plates 32 and vertical deflection plates 34 by conventional deflection circuits 36. Storage tube 10 is additionally provided with one or more flood guns 38 for bombarding the storage dielectric uniformly with low velocity electrons. The cathodes of the flood guns are connected to a low voltage, suitably ground potential (0 volts).

A plurality of electrodes is disposed on the inner surface of envelope 12 intermediate flood guns 38 and target 16. These electrodes preferably are provided as spaced coatings, or bands, of a conductive material such as silver, graphite, or the like. A first wall band electrode 40 functions primarily as a focusing electrode for the flood electrons emitted by guns 38. It is connected to a suitable positive voltage, about +250 volts, for example. A second wall band electrode 42 spaced from electrode 40 and connected to a less positive voltage, e.g., about +150 volts, functions as a focusing and collimating electrode. A third wall band electrode 44 spaced from electrode 42 is connected to a still less positive voltage, e.g., about +125 volts, and also functions as a focusing and collimating electrode. A fourth wall band electrode 46 is located intermediate and spaced from electrode 44 and storage target 16. Electrode 46 is connected to a still less positive voltage (about +75 volts) and functions as a focusing and collimating electrode, but may also act as an auxiliary collector for secondary electrons emitted by the storage target. As a result of the collimating action of the wall band electrodes, flood gun electrons are subtantially uniformly distributed over the surface of target 16.

It should be noted that a conventional resistive coating 48, such as Aquadag, is provided on the interior of the funnel portion of envelope 12 and is electrically connected to an isolation shield (not shown) in writing gun 22. Coating 48 thus serves as an extension of the writing gun's second anode (not shown). The voltages applied to wall band electrodes 40, 42, 44, and 46 are suitably adjusted to provide optimum focusing and collimation of the flood gun electrons, and the specific values given herein and shown on the drawing are by way of example only.

Target electrode 18 is suitably connected to the midpoint of a voltage divider consisting of resistors 50 and 52. Resistor 50 is adjusted so that a potential of about +150 volts is applied to the target electrode.

The cathode of writing gun 22 is connected to a high negative D.C. potential, suitably about −3000 volts. The control grid 26 is connected to the movable contact of a single pole, double throw switch 53. In the STORE position of the switch, grid 26 is connected to a negative D.C. potential −VG1 to provide a suitable grid-to-cathode reverse bias to cause writing beam 30 to bombard target 16 with high velocity electrons. When struck by the writing beam, dielectric layer 20 emits secondary electrons, which are then collected by electrode 18 (and to some extent by electrode 46). The written area of the layer is driven positive by the secondary emission, and retained at a relatively positive potential after beam 30 has passed by low energy electrons emitted by flood guns 38. In this well known manner a stored charge image is formed on the dielectric layer. In the W.T. or write-through position of switch 53, the control grid is connected to the output of a rectangular pulse generator 54, which applies positive-going voltage pulses 56 to the grid. Pulses 56 have a maximum voltage level equal to −VG1, and a minimum (more negative) voltage level sufficient to turn off the writing gun. Switching the writing beam off for a portion of the time it is bombarding a particular area of the target allows the charge image formed in the storage dielectric to be discharged by the flood electrons. The write-through image is thus prevented from being stored. A more complete description of pulsed write-through operation may be had by reference to U.S. Pat. No. 3,430,093 to Winningstad.

Figure 2:
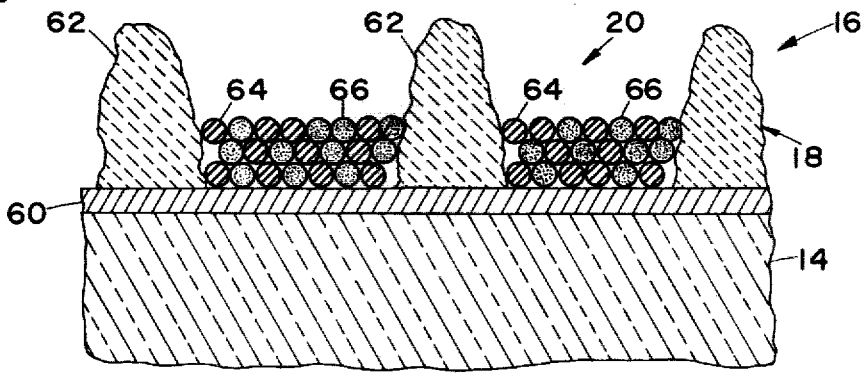
FIG. 2 is a fragmentary cross-sectional view taken along line 2—2 of FIG. 1, showing on an enlarged scale a preferred embodiment of a storage target in accordance with the present invention.

Referring now to FIG. 2, there is illustrated in cross section the storage target incorporated in storage tube 10. Target 16 includes a transparent substrate body in the form of faceplate 14, which is provided with a thin, conductive tin oxide film 60. A multiplicity of raised "dots" 62 of a conductive material such as cobalt is distributed in a regular pattern over the exposed surface of film 60. The dots, which suitably have a generally cylindrical configuration, are electrically connected to the tin oxide film. Thus, conductive film 60 and cobalt dots 62 together form collector or target electrode 18. Disposed on electrode 18 is an at least semi-continuous storage dielectric layer 20. According to the present invention, layer 20 comprises an admixture of phosphor particles, including particles 64 of a phosphor capable of bistable storage of charge images, and particles of another phosphor 66. Phosphor 66 is chosen to have a color emission different, and preferably substantially different, from that of phosphor 64 when bombarded by high energy electrons, and to have a substantially lower light output efficiency when bombarded by low energy flood gun electrons. Suitable phosphors meeting these criteria include the red-emitting P-22R phosphors, such as $Y_2O_2S$:Eu, $Y_2O_3$:Eu, and $YVO_4$:Eu. Phosphor 64 suitably is a green-emitting storage phosphor such as P-1($Zn_2SiO_4$:Mn).

The two types of phosphor particles are uniformly admixed, either dry or in slurry form, and deposited on target electrode 18 in a known manner, for example using the procedure outlined in U.S. Pat. No. 3,956,662 to McTeague, et al. The ratio of the two types of phosphor in the admixture may range from about 10% to about 90% by weight of phosphor 64, with the balance being phosphor 66. A preferred composition comprises 30 to 40% by weight P-1 and the balance a P-22R phosphor (or a mixture of P-22R phosphors) of the rare earth type mentioned above. A storage target provided with a dielectric layer of the preferred composition will exhibit a green display of stored charge images and an orange display of write-through charge images. By way of explanation only, it is thought that the P-1 and P-22R phosphors have similar efficiencies when bombarded by relatively high voltage (i.e., high energy) electrons such as those emitted by writing gun 22 in storage tube 10. Thus the perceived color emitted by the storage layer in write-through image areas will be a combination of the green and red light emitted by the two types of phosphors. The greater percentage of red-emitting phosphor results in an orange display. In stored image areas, which are illuminated only by low voltage flood gun electrons, phosphor 66 has a substantially lower efficiency than the storage phosphor in the admixture, and contributes little to the perceived color. As a result, stored images appear green, as does the background luminance of the target.

It will be understood that color coding of write-through information is not restricted in application to the storage tube target structure exemplified herein. Other suitable target structures include those described in U.S. Pat. Nos. 3,293,473 to Anderson; 3,293,474 to Gibson, Jr.; 3,401,293 to Morris; 3,531,675 to Frankland; 3,614,820 to Morris; and 3,978,366 to Steele.

From the above it should be obvious to one of ordinary skill in the art that various changes may be made in the above-described preferred embodiment without departing from the scope of the invention as defined by the following claims.

I claim:

1. A direct viewing cathode ray storage tube, comprising an evacuated envelope having a light transparent faceplate, a storage target including a storage dielectric of phosphor material mounted within said envelope, means for bombarding said storage dielectric with a beam of high velocity electrons to form a charge image thereon, and means for bombarding said storage dielectric with low velocity electrons to cause bistable storage of charge images having a potential at least equal to a critical minimum voltage necessary for such storage, and to prevent storage of charge images having a potential below said critical minimum voltage, said phosphor material comprising a substantially uniform admixture that includes a first phosphor capable of bistable storage of charge images and a second phosphor having a color emission different from that of said first phosphor and having a light output efficiency in response to bombardment by said low velocity electrons that is lower than that of said first phosphor, such that bombardment of the admixed material by said high velocity electrons causes the emission of a light image of a certain perceived color, and bombardment of said material by said low velocity electrons causes the emission of a light image corresponding to a storage charge image, the latter light image being of a perceptibly different color.

2. The storage tube of claim 1, wherein said phosphor target comprises an admixture of P-1 phosphor and P-22R phosphor.

3. The storage tube of claim 2 wherein said P-22R phosphor is selected from the group consisting of $Y_2O_2S$:Eu, $Y_2O_3$:Eu, $YVO_4$:Eu, and mixtures thereof.

4. The storage tube of claim 2, wherein said admixture contains from about 30% to about 40% by weight of P-1 phosphor, the balance being P-22R phosphor.

5. A direct viewing storage target for a cathode ray tube, comprising a light transparent substrate of electrically insulative material, means supported by said substrate defining a collector electrode, and a dielectric layer of phosphor material on one side of said substrate, said phosphor material comprising a substantially uniform admixture of phosphor particles, including particles of a first phosphor capable of bistable storage of charge images and particles of a second phosphor that emits light of a different color than said first phosphor in response to bombardment by high velocity electrons from a cathode ray storage tube writing gun, and that has a light output efficiency lower than said first phosphor in response to bombardment by low velocity electrons from a cathde ray storage tube flood gun.

6. The target of claim 5, wherein said first phosphor is P-1 phosphor and said second phosphor is P-22R phosphor.

7. The target of claim 6, wherein said admixture contains from about 30% to about 40% by weight of said P-1 phosphor, the balance being P-22 phosphor.

8. The target of claim 7, wherein said P-22R phosphor is selected from the group consisting of $Y_2O_2S$:Eu, $Y_2O_3$:Eu, $YVO_4$:Eu, and mixtures thereof.

9. A method of displaying in different colors stored and write-through charge images produced on the same storage dielectric of a direct viewing bistable storage cathode ray tube having writing means for bombarding said storage dielectric with high velocity electrons to produce said charge images and means for bombarding said dielectric with low velocity electrons to cause bistable storage of charge images having a potential at least equal to a critical minimum voltage necessary for such storage, and to prevent storage of charge images having a potential below said critical minimum voltage, and wherein said dielectric comprises a substantially uniform admixture of phosphor particles, including particles of a first phosphor capable of bistable storage of charge images and particles of a second phosphor having a color emission in response to bombardment by high velocity electrons that differs from that of said first phosphor and having a light emission efficiency under bombardment by low velocity electrons that is lower than that of said first phosphor, comprising the steps of:

bombarding said storage dielectric with a beam of high velocity electrons of sufficiently high current and time per unit area to form a first, storable chage image on said dielectric, bombarding said storage dielectric with low velocity electrons to cause bistable storage of said first charge image and emission of a light image display of a first color, and bombarding said storage dielectric with a second beam of high velocity electrons to form a second charge image incapable of being stored during bombardment of said dielectric by said low velocity electrons, said second beam being nevertheless capable of producing a light image display corresponding to said second charge image, which display is of a color different from said first color.

10. In a direct viewing cathode ray storage tube comprising an evacuated envelope having a light transparent faceplate, a storage target including a storage body of phosphor material mounted within said envelope, writing gun means for bombarding said storage body with a beam of high velocity elections to form a charge image thereon, and flood gun means for bombarding said storage body with low velocity electrons to cause bistable storage of charge images having a potential at least equal to a critical minimum potential necessary for such storage and to prevent storage of charge images having a potential below said critical minimum potential, the improvement wherein said phosphor material comprises a substantially uniform admixture that includes particles of a first, bistable storage phosphor that in response to electron bombardment luminesces in a first color, and particles of a second phosphor that in response to electron bombardment luminesces in a second color, said second phosphor having a substantially lower relative luminescent efficiency when bombarded by flood gun electrons, so that bombardment of the admixed material by writing gun electrons causes it to emit light of a certain perceived color and bombardment by flood gun electrons alone causes it to emit light of a perceptibly different color.

* * * * *